United States Patent [19]

Achilles, Sr.

[11] 4,455,996

[45] Jun. 26, 1984

[54] CHIMNEY SENTINEL

[76] Inventor: Louis V. Achilles, Sr., Box 384, Sunapee, N.H. 03782

[21] Appl. No.: 412,182

[22] Filed: Aug. 27, 1982

[51] Int. Cl.[3] ..... F23M 7/00; F24D 15/04

[52] U.S. Cl. ..... 126/200; 431/13; 126/312

[58] Field of Search ..... 126/85, 312, 200–293; 237/55; 165/DIG. 2; 110/119; 431/13

[56] References Cited

U.S. PATENT DOCUMENTS

| | | | |
|---|---|---|---|
| 205,985 | 7/1878 | Way . | |
| 254,049 | 2/1882 | Robinson . | |
| 424,035 | 3/1890 | Sweetland . | |
| 673,476 | 5/1901 | Robinson . | |
| 941,900 | 11/1909 | Wood . | |
| 2,072,758 | 3/1937 | Libby | 126/312 |
| 2,531,139 | 11/1950 | Lilly et al. | 126/85 |
| 2,545,148 | 3/1951 | Jones | 126/293 |

FOREIGN PATENT DOCUMENTS

| | | | |
|---|---|---|---|
| 829779 | 1/1952 | Fed. Rep. of Germany | 36 B/2 |
| 712861 | 3/1931 | France . | |

*Primary Examiner*—Albert J. Makay
*Assistant Examiner*—Henry Bennett
*Attorney, Agent, or Firm*—Woodcock, Washburn, Kurtz, Mackiewicz & Norris

[57] ABSTRACT

A novel chimney sentinel is disclosed which facilitates detection of wood stove flue fires. A sight glass is provided which is kept clear during use through a controlled ventilation of the interior surface of the sight glass. The sight glass is easily removed by hand, even during flue operation, to provide fire extinguisher access to the flue interior.

11 Claims, 5 Drawing Figures

CHIMNEY SENTINEL

CROSS-REFERENCE TO RELATED APPLICATIONS

This is a substitute application for U.S. patent application Ser. No. 184,489 filed Sept. 5, 1980, entitled "Chimney Fire Safety," now abandoned.

BACKGROUND OF THE INVENTION

The present invention relates to the field of fire safety devices for preventing flue fires, and particularly to such devices which are suited for use with wood stove flues or chimneys.

In recent years there has been considerable interest in the use of wood stoves as domestic heating devices. While such stoves have achieved considerable commercial success, some care must be taken in connection with their use to prevent excessive build-up of creosote and soot on the interior flue pipe surfaces. Even with periodic cleaning, in certain installations creosote and soot build-up can be quite rapid and is likely to lead to a chimney pipe fire.

Unfortunately there is often no way to detect the early stages of a chimney or flue pipe fire. As such a fire progresses, however, the heat generated within the flue may eventually lead to a fire which spreads to the adjoining structure. Accordingly, it would be highly desirable to detect flue or chimney pipe fires in their early stages, and to provide simple inexpensive methods for promptly extinguishing those fires to minimize the damage caused thereby.

Over the years, many flue pipe dampers, ventilators and clean-outs have been suggested, some of which might provide visual or manual access to the interior of a flue pipe. Fire detection and control were not objects of most of these devices nor were these devices generally suited for use with modern wood stoves which minimize the amount of room air drawn by the stove-flue assembly to thereby maximize the effective heating capacity of that assembly. Additionally, since the maintenance of a relatively higher flue pipe temperature tends to prevent creosote and other gases from condensing on the interior surfaces of the flue pipe, the introduction of excessive volumes of ambient air which (would have the effect of cooling flue gases, and thus accelerating creosote deposition) should be avoided.

For examples of the above-described prior art devices, please refer to U.S. Pat. No. 2,531,139 (Lilly et al) (Heater with Safety Screen Air Inlet), German Pat. No. 829,779 (Diermayer); U.S. Pat. No. 424,035 (Sweetland) (Hot Air Furnance); and French Pat. No. 721.861 (Dreyfus), each of which were cited in connection with my above-identified related application. See also the following patents relating to stove pipes comprising ventilating means: U.S. Pat. No. 205,985, now U.S. Pat. No. 4,325,917 (Way) (Stove Pipe Ventilator); U.S. Pat. No. 254,049, now abandoned (Robinson) (Stove Pipe); U.S. Ser. No. 673,476 (Robinson); U.S. Pat. No. 941,900, now U.S. Pat. No. 4,197,480 (Wood) (Combined Ventilator and Smoke Consumer); U.S. Pat. No. 2,072,758 (Libby) (Soot and Creosote Eliminator) and U.S. Pat. No. 2,545,148 (Jones) (Flue Pipe Section with Check Draft Damper).

Thus, a need still exists to detect and prevent flue fires in a manner which does not unduly increase their incidence.

SUMMARY OF THE INVENTION

The present invention provides a novel flue pipe fire safety device which facilitates visual detection of flue pipe fires, and which provides quick access to such fires by conventional fire extinguishers.

The chimney sentinel of the present invention comprises a hollow bushing which seals an opening in the flue pipe, a mica sight glass which covers the opening in that bushing, and a bushing cap which retains and seals the sight glass over the bushing opening. A condensation prevention means is provided to keep the sight glass clear and the bushing cap cool during use. This means comprises a plurality of alignable apertures defined through the bushing and bushing cap. These apertures are radially spaced around and adjacent to the interior surface of the sight glass to cause ambient air to be drawn across that surface during use. In the preferred embodiment the bushing and its cap are complementally threaded. The bushing has several sets of apertures defined therein which are separately alignable with at least some of the cap apertures upon rotation of the cap. The use of a mica sight glass provides sufficient elasticity to retain the cap in proper alignment in several positions of rotation.

Accordingly, a primary object of the present invention is the provision of a novel flue pipe fire safety device.

Another object of the present invention is the provision of a quick access fire extinguisher port.

These and other objects of the present invention will become apparent from the following more detailed description.

DESCRIPTION OF THE PREFERRED EMBODIMENT

Although specific examples are referred to in the following description for purposes of illustration, those of ordinary skill in this art will recognize that various modifications may be made to the materials and methods described herein without departing from the scope of the present invention, which is defined more particularly in the appended claims.

Figure 1:
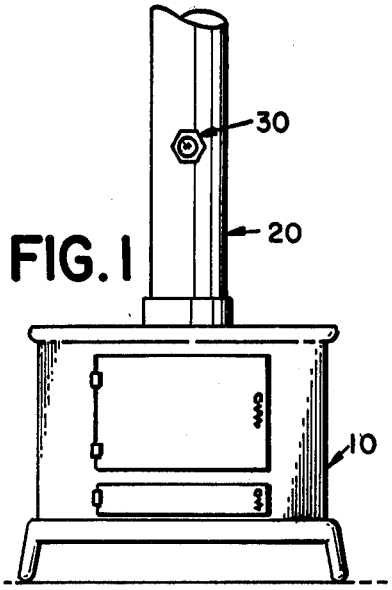
FIG. 1 is a front view of a wood stove-flue pipe installation showing the preferred embodiment chimney sentinel safety apparatus installed in the flue pipe.
Figure 2:
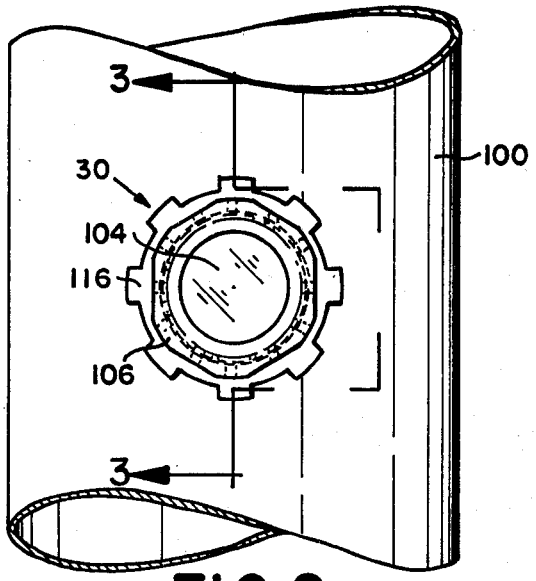
FIG. 2 is an enlarged front view of a portion of the stove pipe of FIG. 1 showing the preferred embodiment apparatus of FIG. 1 in greater detail.

The present invention provides a novel chimney sentinel apparatus which facilitates the detection of wood stove flue fires. As seen in FIG. 1, the preferred chimney sentinel apparatus, designated generally 30, is mounted within and through the wall of a stove pipe, designated generally 20, which had been installed to exhaust flue gases from a wood stove, designated generally 10.

The preferred chimney sentinel apparatus is a flue pipe safety apparatus which generally comprises a hollow bushing, a sight glass means for covering the remote bushing opening and for permitting the viewing of the interior of the flue through the bushing, and a bushing cap means removably mounted on the bushing for retaining the sight glass means over the bushing opening. The hollow bushing 102 sealingly engages the aperture in the flue pipe by clamping the periphery of the flue pipe aperture between bushing base flange 102*c* and a nut 116 which is complementally threaded over bushing threads 102*b*, and tightened in place. The hollow bushing extends away from the pipe 100 to define a remote bushing opening which is covered by the sight glass 104. In the preferred embodiment, the sight glass is preferably composed of a thin wafer of transparent or translucent mica, which is heat resistant and which exhibits a certain degree of elasticity. Although heat resistant glass may be used in place of mica, such glass is not presently preferred due to its lack of elasticity.

Sight glass 104 is retained and sealed with respect to the bushing opening by bushing cap 106 which comprises cap threads 106*a* which mate with bushing threads 102*b*. When the bushing cap is screwed into the position shown in FIG. 3, the sight glass 104 is sealed with respect to the bushing end portion 102*a*.

Figure 3:
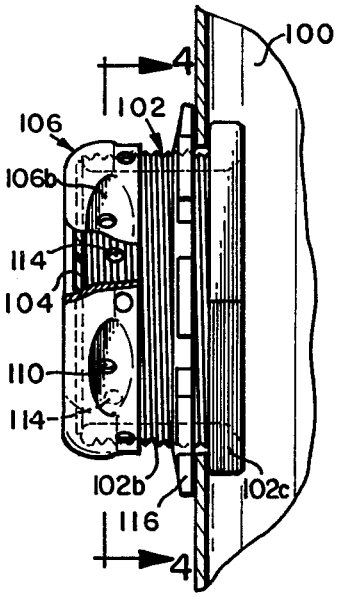
FIG. 3 is an enlarged cross section of the preferred embodiment device of FIG. 2 taken in accordance with the lines and arrows 3—3 on FIG. 2.
Figure 4:
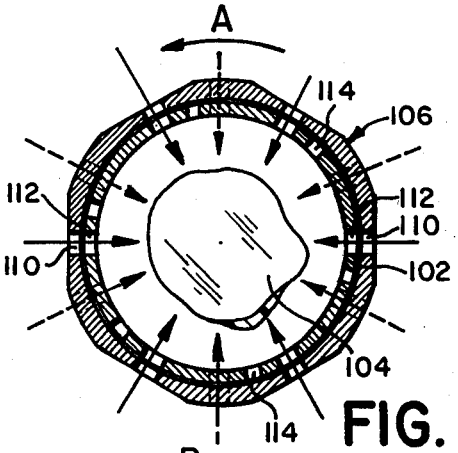
FIG. 4 is a cross section of the preferred embodiment apparatus of FIG. 3 taken in accordance with the lines and arrows 4—4 on FIG. 3.
Figure 5:
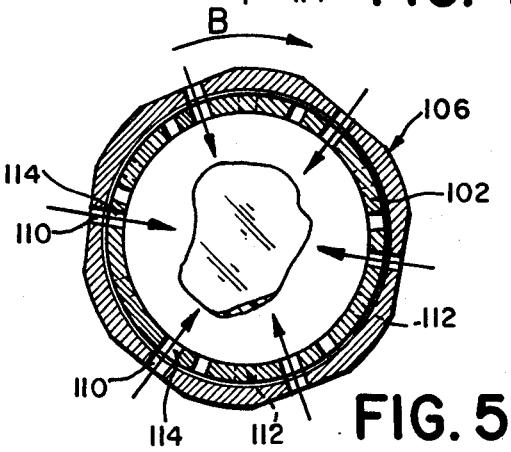
FIG. 5 is also a cross section of the preferred embodiment device shown in a view similar to that of FIG. 4, but wherein cap 106 has been rotated in the direction of arrow A in FIG. 4 to create a different aperture alignment, and therefore a different ventilation of the interior surface of the sight glass 104.
Figure 6:
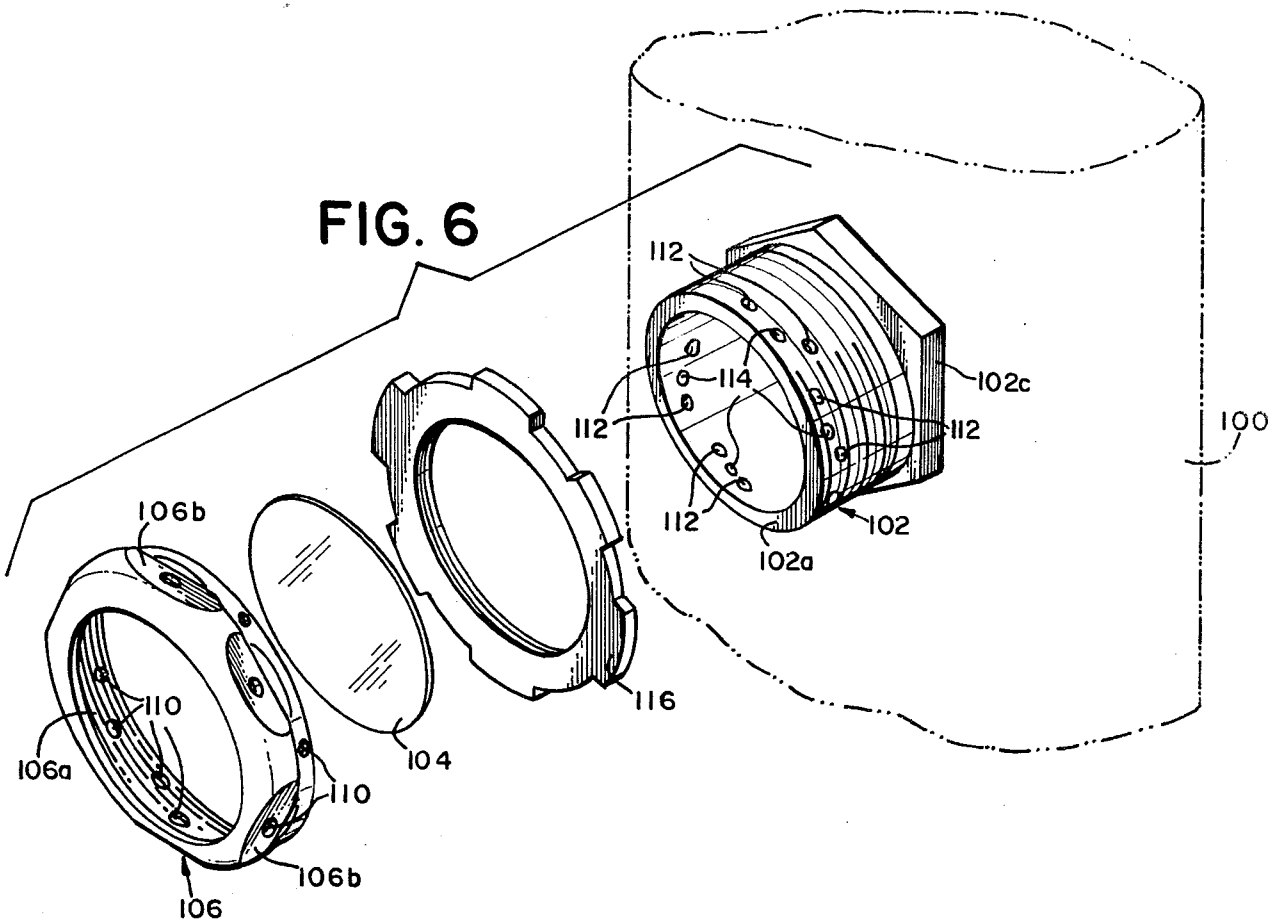
FIG. 6 is an exploded isometric view of the preferred embodiment of FIGS. 1-5.

The preferred embodiment of the present invention further comprises condensate prevention means for reducing the condensation of smoke on the sight glass means during operation of the flue. The condensate prevention means comprises a plurality of alignable apertures which are substantially adjacent to the interior of the sight glass means, and are defined by the bushing cap means and the hollow bushing. The bushing cap defines one set of apertures 110 which are uniformly radially spaced around the periphery of the cap, but which are slightly staggered with respect to the axis of the bushing, as illustrated in FIG. 6. In the preferred embodiment, the bushing cap comprises a set of twelve apertures, six of which are defined in flats 106*b* of the bushing cap. The bushing 102 comprises two sets of apertures, each of which is separately alignable with respect to complemental apertures in the bushing cap. These apertures, when aligned, cause ambient air to be drawn across the interior surface of the sight glass means during the operation of the flue. As seen in FIGS. 3–6, bushing 102 defines a total of eighteen apertures, a first set of twelve apertures 112 and a second set of six apertures 114. When bushing cap 106 is tightened hand tight as shown in FIG. 3, apertures 112 of the bushing align with apertures 110 of the cap to create twelve small air passages disposed at every 30° radially around the sight glass in a position generally adjacent to the interior surface of that sight glass. When the bushing cap 106 is slightly loosened, in the direction of arrow A in FIG. 4, apertures 112 of bushing 106 are sealed by the threaded portion 106*a* of cap 106, and the second set of apertures 114 of the bushing may be aligned with the six apertures 110 of the cap which are defined through the flats 106*b* of the cap. The air flow illustrated in FIG. 5 is then created wherein small air intakes are disposed at every 60° radially around the sight glass. Applicant has found that the elasticity of the threads and the mica material which is preferred as the sight glass are such that the bushing cap will be retained in the position shown in FIG. 5 during normal use. Accordingly, the user may easily select between greater and lesser sight glass ventilation depending upon the particular flue pipe installation, wood stove pipe etc. In either of the ventilated settings, it has been found that the sight glass will remain relatively clear, that is, there will not be an undue acculumation of condensate on the interior surface of the sight glass.

A further feature of the present invention resides in its provision of easy and safe access to the interior of the flue pipe 100 in the event a flue fire should be observed through the sight glass. Applicant has found that even after prolonged periods of use, the bushing cap 106 is not prone to "freezing" in position, but rather may be easily removed in the event of a fire, whereupon a fire extinguisher nozzel may be directed into the interior of the flue pipe to readily extinguish a flue pipe fire in its early stages. It is presently theorized that cap 106 is not prone to freezing by reason of the provision of aperture alignments which discourage over tightening, and also by reason of the aforementioned ventilation system which retards the accumulation of creosote and soot in the vicinity of the cap and cap threads. The condensate prevention means also cools the bushing end and cap and makes it possible to remove the cap without protective gloves, even when the flue is in use. Once the cap and sight glass are removed, the opening may also be used as a clean out for vacuum cleaner access.

As seen from the above, an extremely simple yet reliable flue pipe safety device has been described which not only facilitates the rapid detection of flue pipe fires, but also provides quick extinguisher access to those fires. This device is readily installed in existing flues, or may be provided in combination with a presized flue pipe section.

What is claimed:

1. A flue pipe safety apparatus comprising:

(a) a hollow bushing sealingly engaging an aperture in said flue pipe and extending away from said pipe to define a remote bushing opening;

(b) sight glass means for covering said remote bushing opening and for permitting the viewing of the interior of said flue through said bushing;

(c) bushing cap means removably mounted on said bushing for retaining said sight glass means over said opening; and (d) condensate prevention means for reducing the condensation of smoke on said sight glass means said condensate prevention means comprising a plurality of alignable apertures substantially adjacent to the interior surface of said sight glass means defined by said bushing cap means and said hollow bushing, said apertures being disposed when aligned to cause ambient air to be drawn across the interior surface of said sight glass means during flue operation.

2. The apparatus of claim 1 wherein said bushing and said bushing cap means comprise complementally threaded portions.

3. The apparatus of claim 2 wherein said condensate prevention means comprises a plurality of sets of alignable apertures defined in said bushing.

4. The apparatus of claim 3 wherein a first of said sets of apertures is sealed by said cap means when a second of said sets of apertures is aligned with apertures of said cap means.

5. The apparatus of claim 4 wherein said bushing is clamped to a portion of said flue by a nut threaded onto said threaded portion of said bushing.

6. The apparatus of claim 5 wherein said cap defines a plurality of flats, and wherein a plurality of said apertures are defined through said flats.

7. The apparatus of claim 4 wherein said apertures are radially spaced around said sight means.

8. The apparatus of claim 7 wherein said sets comprise sets of six and twelve apertures disposed about every 60° and 30° respectively around the periphery of said sight glass means.

9. The apparatus of claim 8 further comprising a section of said flue pipe defining said aperture sealed by said bushing.

10. The apparatus of claim 1 wherein said sight glass means comprises a mica sight glass.

11. The apparatus of claim 1 wherein said condensate prevention means further comprises means for cooling at least said bushing cap so that said bushing cap may be removed by an unprotected hand even during operation of the flue.

* * * * *